US007976681B2

(12) United States Patent
Da Silva

(10) Patent No.: US 7,976,681 B2
(45) Date of Patent: Jul. 12, 2011

(54) APPARATUS TO PRODUCE A FIBROUS WEB

(75) Inventor: Luiz C. Da Silva, Campo Limpo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/487,974

(22) Filed: Jun. 19, 2009

(65) Prior Publication Data

US 2009/0283236 A1 Nov. 19, 2009

Related U.S. Application Data

(63) Continuation of application No. PCT/EP2007/064201, filed on Dec. 19, 2007.

(30) Foreign Application Priority Data

Dec. 22, 2006 (DE) ..... 10 2006 062 236

(51) Int. Cl.
*D21G 3/00* (2006.01)

(52) U.S. Cl. ..... 162/272

(58) Field of Classification Search ..... 162/272, 162/296, 358.3

See application file for complete search history.

(56) References Cited

U.S. PATENT DOCUMENTS

| | | | |
|---|---|---|---|
| 4,529,480 | A | 7/1985 | Trokhan |
| 2003/0136018 | A1 | 7/2003 | Herman et al. |
| 2005/0126031 | A1 | 6/2005 | Herman et al. |
| 2005/0167066 | A1 | 8/2005 | Herman et al. |

FOREIGN PATENT DOCUMENTS

| | | | |
|---|---|---|---|
| DE | 3222428 | A1 | 12/1983 |
| WO | 0075423 | A1 | 12/2000 |
| WO | 2005075737 | A1 | 8/2005 |

OTHER PUBLICATIONS 11 pages of documents for PCT/EP2007/064201 dated May 2, 2008.

*Primary Examiner* — Mark Halpern
(74) *Attorney, Agent, or Firm* — Taylor IP, P.C.

(57) ABSTRACT

An apparatus to produce a fibrous web having a three-dimensional surface structure, especially a paper, cardboard or tissue web, includes a headbox, a forming element, especially a forming roll, a structured fabric and a dewatering fabric, whereby the structured fabric and the dewatering fabric run together and form a stock infeed nip and are carried over the forming element whereby the structured fabric is the inside fabric and the dewatering fabric is the outside fabric and whereby fibrous suspension is fed into the stock infeed nip by way of the headbox. At least one catch pan is provided in the area of the outfeed nip which is formed between the forming element and the structured fabric coming off it for water, fibers, fines and/or similar substances accumulating in the area of this outfeed nip.

38 Claims, 4 Drawing Sheets

APPARATUS TO PRODUCE A FIBROUS WEB

CROSS REFERENCE TO RELATED APPLICATIONS

This is a continuation of PCT application No. PCT/EP2007/064201, entitled "APPARATUS FOR PRODUCING A FIBROUS WEB", filed Dec. 19, 2007 which is incorporated herein by reference.

BACKGROUND OF THE INVENTION

1. Field of the Invention

The invention relates to an apparatus to produce a fibrous web having a three-dimensional surface structure, especially a paper, cardboard or tissue web and which is equipped with a headbox, a forming element, especially a forming roll, a structured fabric and a dewatering fabric, whereby the structured fabric and the dewatering fabric run together and form a stock infeed nip and are carried over the forming element whereby the structured fabric is the inside fabric and the dewatering fabric is the outside fabric and whereby fibrous suspension is fed into the stock infeed nip by way of the headbox. An apparatus of this type is described, for example in WO 2005/075737 A1.

2. Description of the Related Art

With an apparatus of this type problems regarding the running characteristics or runability can occur, especially at higher machine speeds. In view of the circumstance that the structured fabric, which may, for example, be a woven wire instead of a felt on which the fibrous web is formed, carries a large volume of water along with it and is open—in other words is highly permeable—and based on the fact that the basis weight of the fibrous web is very low, a very large volume of water is drawn through the fibrous web into the area of the outfeed nip between the forming element, or respectively the forming roll, and the structured fabric running off the forming roll. As can be seen from the layout in FIG. 1, this causes a large volume of spray water 18 during the tissue production process in the area of the outfeed nip 10 between the forming roll 12, over which the structured fabric 14 and the dewatering fabric 16 are guided, and the structured fabric 14 running off the forming roll 12.

As can be seen in FIG. 1 the structured fabric 14 is carried over the forming roll 12 as the inside fabric and the dewatering fabric 16 as the outside fabric. The two fabrics 14, 16 run together, thereby forming a stock infeed nip 20. The fibrous stock suspension from which the fibrous web 24 is eventually formed is fed into the stock infeed nip 20 by way of a headbox 22. The forming roll 12 may possess an open surface and is preferably in the embodiment of a solid roll. Accordingly, dewatering in the area of the forming roll occurs preferably toward the outside, as indicated by arrows M. The thrown off water is caught in a catch pan 26. The dewatering fabric 16 is carried over guide rolls 28 and is subsequently separated again from the structured fabric 14 and the fibrous web 24 which is transported by it.

As can be seen in FIG. 1 due to the special layout in the form of a Crescent-Former there is a risk that water drops drip back onto the top surface of the structured fabric 14 which carries the fibrous web 24 along on its bottom surface. This could create holes and stains in the produced fibrous web.

An additional disadvantage is that the water which was removed from the fibrous web 24 in the manner described also contains fibers and fines which accumulate on the top surface or inside surface of the structured fabric 14. If a suction box, especially for wet embossing, is provided inside the loop of the permeable structured fabric 14, then fibers and fines can also accumulate on the front side of such a suction box.

An additional disadvantage of the aforementioned devices of the type described consists in that the guide rollers which are located inside the loop of the structured fabric clog within a very short time period with fibers and fines. This results in the production machinery having to be shut down at short intervals for cleaning purposes which inevitably leads to corresponding production losses.

What is needed in the art is an improved apparatus of the type mentioned at the beginning whereby the aforementioned disadvantages are eliminated. In particular, the runability and efficiency of the apparatus are to be increased.

SUMMARY OF THE INVENTION

The present invention provides that in the area of the outfeed nip which is formed between the forming element and the structured fabric running off the forming element at least one catch pan is provided for water, fibers, fines, and/or other substances accumulating in the area of this outfeed nip.

Considerably higher runnability and higher efficiency of the apparatus result due to this configuration. The catch pan located in the area of the outfeed nip ensures that water drops no longer get onto the structured fabric. The invention is particularly applicable in tissue production, as described in WO 2005/075737 A1.

The catch pan includes preferably an outlet and a wall section in order to catch water accumulating in the area of the outfeed nip and to direct it to the outlet.

The outlet is advantageously connected to a vacuum source.

According to one practical advantageous embodiment of the inventive apparatus, the catch pan includes a base section with one side facing the structured fabric, whereby on this side of the base section which is facing the structured fabric at least one suction equipped orifice is provided.

Preferably several suction equipped orifices are provided on the side of the base section facing the structured fabric.

In this arrangement the at least one orifice is advantageously connected with a vacuum chamber which is provided in the base section. This vacuum chamber is advantageously connected with a vacuum source.

The at least one orifice can be especially in the embodiment of a bore, a slot or a similar form.

The structured fabric may possess a progression having a horizontal component in the area adjacent to the forming element. This arrangement also ensures that no water drops get onto the top surface of the structured fabric thanks to the catch pan which is located in the area of the outfeed nip.

The structured fabric is preferably designed as an open or permeable fabric.

In this arrangement this structured fabric possesses advantageously a permeability of >200 cfm, especially >400 cfm and preferably >600 cfm (cfm=cubic feet per minute).

Viewed in direction of web travel at least one suction equipped embossing unit is provided following the forming element and is located on that side of the permeable structured fabric which faces away from the fibrous web and through which the fibrous web is sucked into the structure of the structured fabric.

It is especially advantageous in this arrangement if the suction equipped embossing unit includes a base section with one side facing the permeable structured fabric and a front edge on the fabric side when viewed in the direction of web travel, and if the embossing unit is equipped with at least one suction channel located in the area of the front edge of the base section, in order to suck off contaminants, water drops, fines, fibers, and/or similar substances which are carried along by the permeable structured fabric.

On the side of the base section of the suction equipped embossing unit facing the structured fabric, at least one suction equipped orifice is advantageously provided which can be connected with a vacuum chamber that is provided in the base section of the embossing unit. In this arrangement this vacuum chamber of the embossing unit is advantageously connected with a vacuum source.

The suction channel and the orifice are preferably connected with the same vacuum chamber of the embossing unit.

It is also particularly advantageous if at least one embossing unit is located in an area where the dry content of the fibrous web is <35%.

The apparatus includes preferably a drying unit with a suction roll and a hood allocated to it.

The fibrous web is hereby preferably routed over the suction roll, together with the permeable structured fabric, whereby the fibrous web is positioned between the permeable structured fabric and the suction roll.

The permeable structured fabric and the fibrous web are advantageously pressed against the suction roll by a permeable press belt.

The specific pressing pressure produced by the permeable press belt is hereby preferably ≦1.5 bar and especially ≦1 bar.

It is also of particular advantage if additionally a dewatering fabric which is located between the suction roll and the permeable structured fabric is routed around the suction roll.

It is also of particular advantage if, subsequent to the drying device, the fibrous web is run through a press nip which is formed between a drying cylinder, especially a Yankee-cylinder, and a press element.

Preferably at least one suction equipped embossing unit is provided between the forming element and the drying device.

Alternatively, or in addition at least one suction equipped embossing device can also be provided between the drying device and the press nip which is formed between the drying cylinder the press element.

According to a preferred design variation of the inventive apparatus at least one cleaning device is allocated to at least one guide roll which is located inside the loop of the structured fabric.

The cleaning device can specifically include a doctor blade, a catch pan and/or a similar device.

The machine operating speed is preferably >900 m/min. and preferably >1200 m/min.

The structured fabric is preferably in the embodiment of a woven wire.

The basis weight of the fibrous web is preferably <40 g/m$^2$, preferably <25 g/m$^2$.

The invention is applicable especially in the production of tissue, as described in WO 2005/075737 A1.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 2:
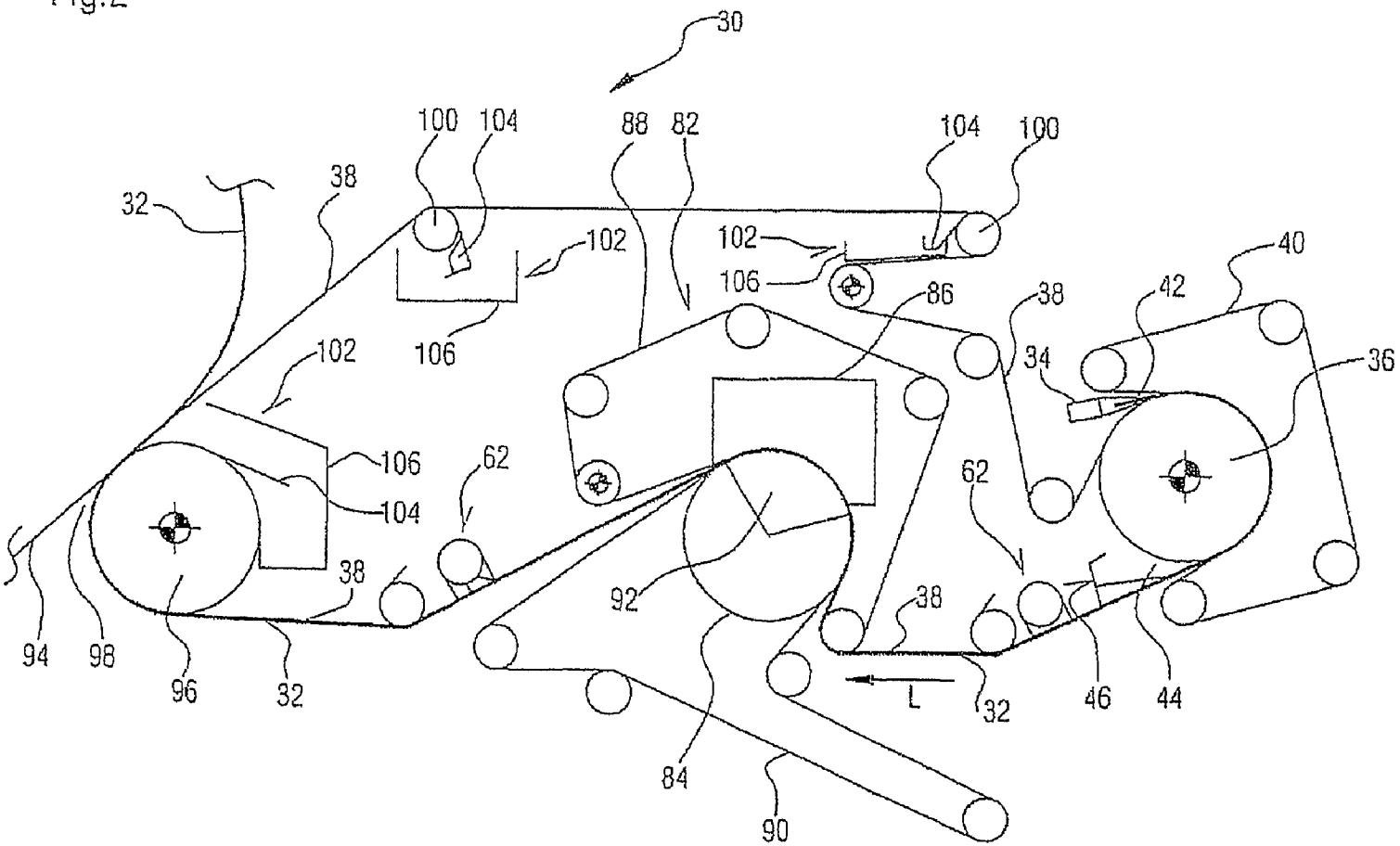
FIG. 2 is a schematic depiction of an example of a design variation of an inventive apparatus for the production of a fibrous web, especially a tissue web with a three-dimensional surface structure.

Referring now to the drawings, and more particularly to FIG. 2, there is shown a schematic depiction of an exemplary embodiment of an inventive apparatus 30 for the production of a fibrous web 32 which has a three-dimensional surface structure, especially a paper, cardboard or tissue web. An advantageous application is in the production of a tissue web.

The apparatus 30 includes a headbox 34, a forming element, especially a forming roll 36, a preferably permeable structured fabric 38 and a dewatering fabric 40.

In this arrangement the structured fabric 38 and the dewatering fabric 40 run together and form a stock infeed nip 42. They are run over the forming roll 36 whereby the structured fabric 38 is the inside fabric and the dewatering fabric 40 is the outside fabric. The fibrous stock suspension is fed into the stock infeed nip 42 by way of the headbox 34.

Figure 3:
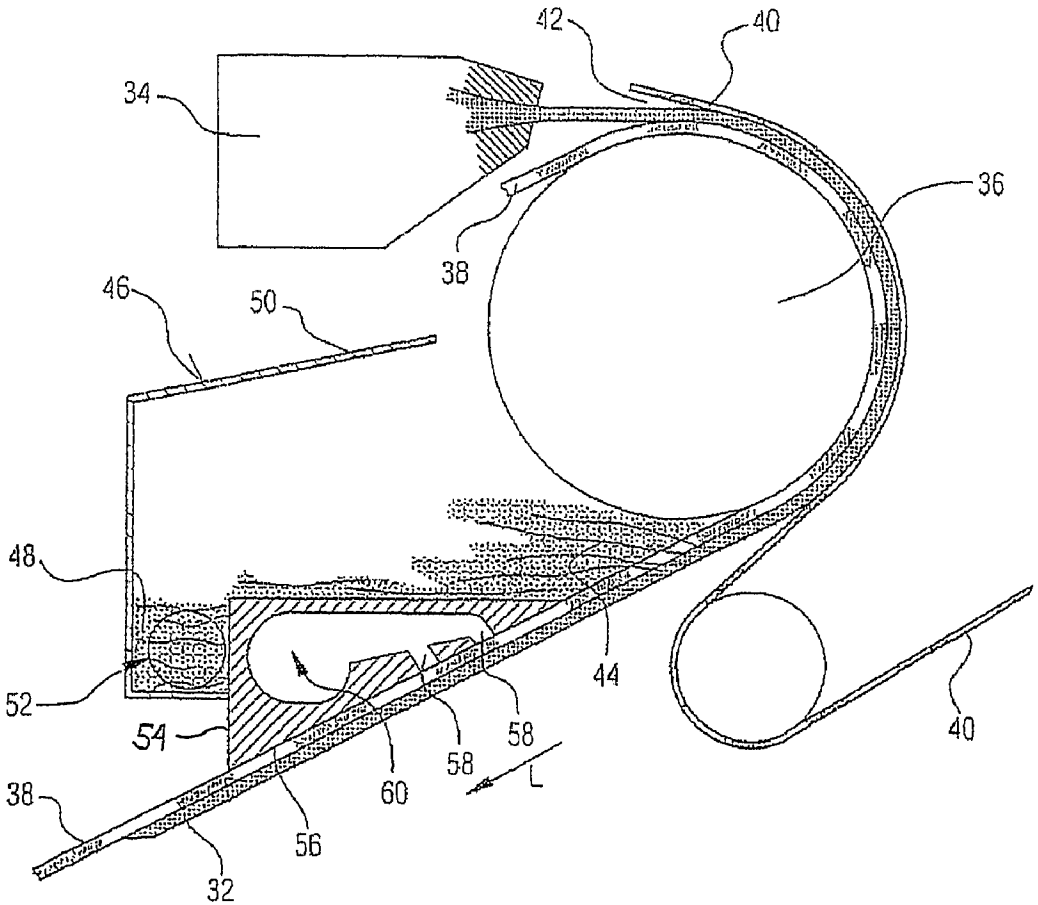
FIG. 3 is an enlarged schematic depiction of the forming area of the device according to FIG. 2.

FIG. 3 is an enlarged schematic depiction of this forming area of the apparatus 30 according to FIG. 2. Corresponding components have been allocated the same reference numbers.

As can be seen especially also in FIG. 3 at least one catch pan 46 is provided in the area of the outfeed nip 44 which is formed between the forming roll 36 and the structured fabric 38 coming off it for water, fibers, fines and/or similar substances occurring in the area of this outfeed nip 44.

Immediately following the forming roll 36, the outside dewatering fabric 40 which is not in contact with the forming roll 36 is again separated from the fibrous web 32 and the permeable structured fabric 38 which supports the web.

The catch pan 46 includes an outlet 48 and a wall section 50 in order to collect water accumulating in the area of the outfeed nip 44 and to direct it to the outlet 48.

The outlet 48 is connected with a vacuum source, for example through a discharge pipe 52 or a similar component.

As can be seen especially in FIG. 3, the catch pan 46 advantageously includes a base section 54 with one side 56 facing the structured fabric 38 on which preferably several suction equipped orifices 58 are provided.

The orifices 58 adjacent to the structured fabric 38 are connected with a vacuum chamber 60 which is located in the base section 54 and which can be connected to a vacuum source.

The orifices 58 can for example be in the form of bores, slots or similar forms. In the illustrated design variation the structured fabric 38 progresses diagonally downward in the area adjacent to the forming roll 36. Hence, its progression possesses a horizontal component. As already mentioned, the structured fabric 38 is preferably designed as an open or permeable fabric.

Figure 1:
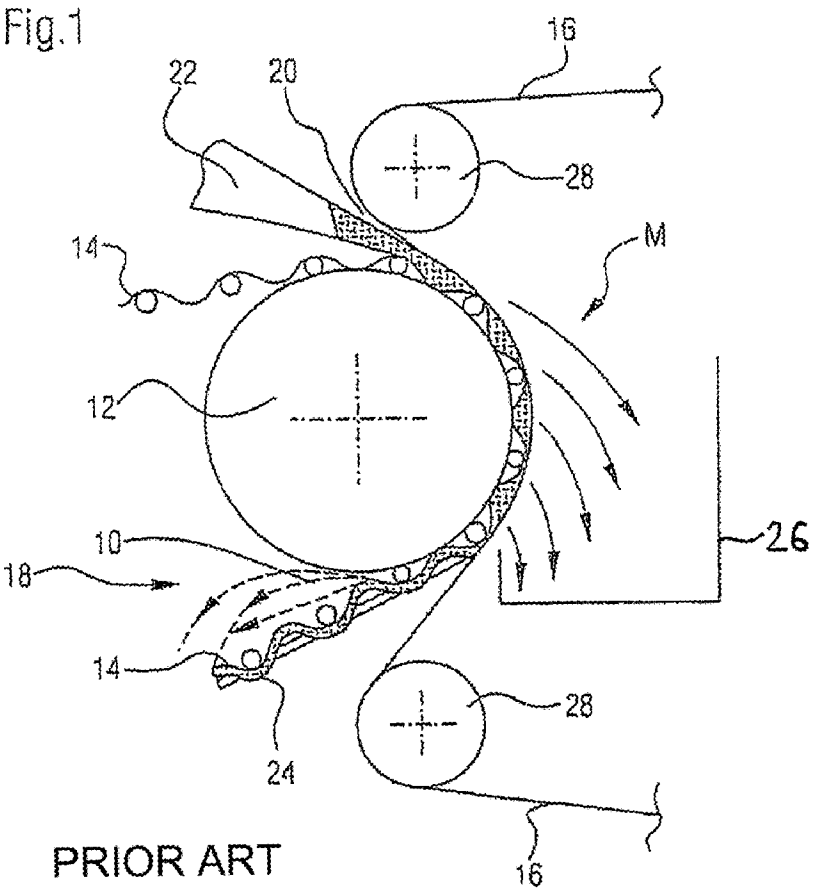
Fig.1 PRIOR ART
FIG. 1 is a schematic depiction of a conventional forming element.

After the forming roll 36 when viewed in direction of web travel L at least one suction equipped embossing unit 62 can be provided which is located on the side of the permeable structured fabric 38 facing away from the fibrous web 32 and through which the fibrous web 32 is sucked into the structure of the structure fabric 38 (compare FIG. 1).

Figure 4:
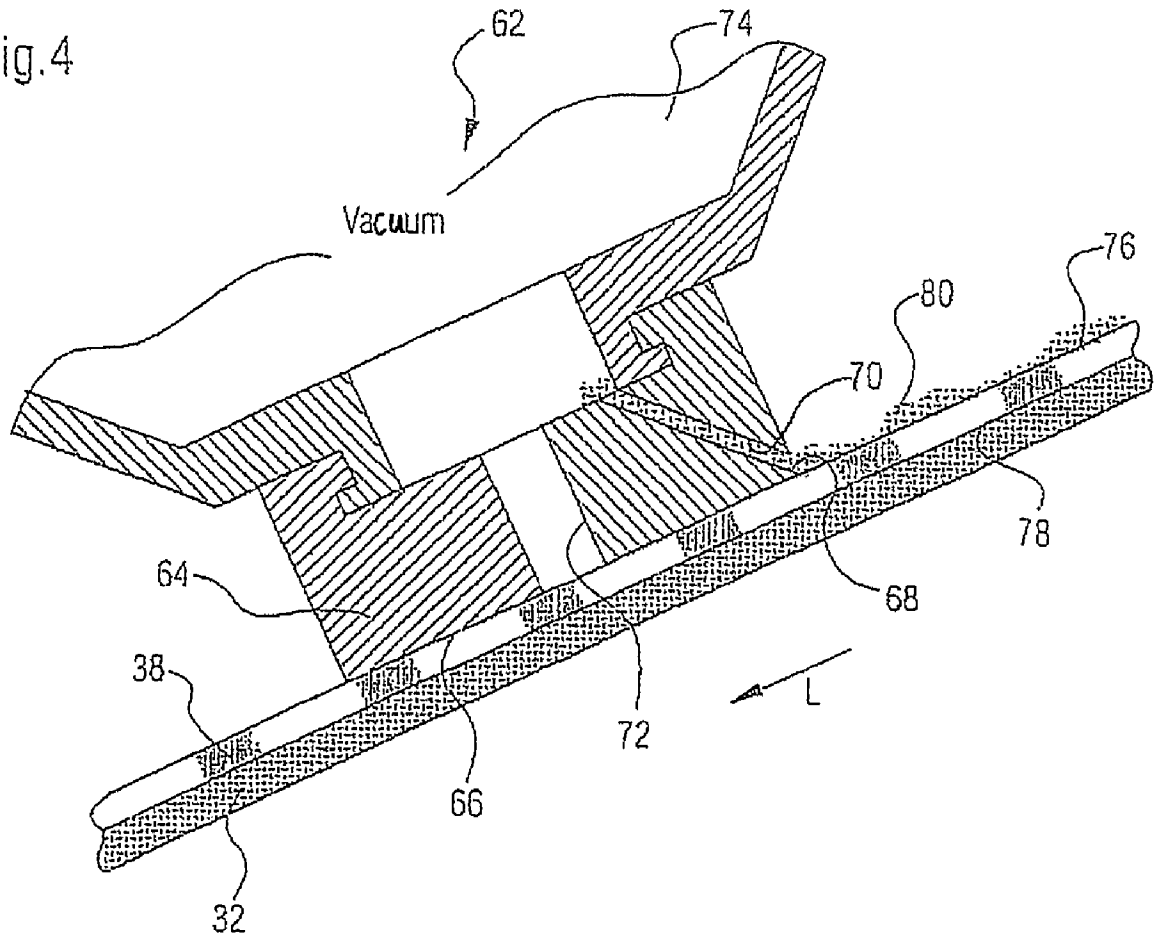
FIG. 4 is an enlarged schematic depiction of an embossing unit of the apparatus according to FIG. 2.

FIG. 4 shows an enlarged schematic illustration of an embossing unit 62 of this type.

As can be seen especially in FIG. 4 a suction equipped embossing unit 62 of this type includes a base section 64 with one side 66 facing the permeable structured fabric 38 and a front edge 68 on the side of the fabric when viewed in direction of web travel L. The embossing unit 62 is equipped with at least one suction channel 70 located in the area of the front edge 68 of the base section 64, in order to suck off contaminants, water drops, fines, fibers, and/or other substances which are carried along by the permeable structured fabric.

In addition at least one suction equipped orifice 72 is provided on the side 66 of the base section 64 of the suction equipped embossing unit 62 which faces the structured fabric 38. This orifice 72 is connected with a vacuum chamber 74 which is located in the base section 64 of the embossing unit 62. The vacuum chamber 74 is advantageously connected with a vacuum source.

In the current design example the suction channel 70 and the orifice 72 are connected with the same vacuum chamber 74 of the embossing unit 62.

Preferably at least one embossing unit 62 is located in an area where the dry content of the fibrous web 32 is <35%.

In the illustration according to FIG. 4 the inside of the structured fabric 38 is identified as "76" and its outside facing the fibrous web 32 is identified as "78".

As can be seen in FIG. 4 particularly fibers and fines 80 are carried along with the structured fabric 38, which are then removed through the suction channel 70 of the suction equipped embossing unit 62.

A suction equipped embossing unit 62 of this type is necessary to produce a fibrous web or tissue web with a three-dimensional surface structure. It supports the formation of the three-dimensional voluminous form of the fibrous web, especially a tissue web, whereby the fibrous web is sucked into the structure of the structured fabric, preferably at a dry content of less than 35%. In order to produce the referred to fibrous web one, or also several, such suction-equipped embossing units 62 may be provided. In order to avoid accumulation of fibers and fines at the front edge of the embossing unit, the suction channel 70 is provided through which contaminants, especially dust or similar substances, water drops, fines and fibers which are carried along by the structured fabric are sucked off.

As can be seen in FIG. 2 the apparatus 30 may additionally include a drying unit 82 with a suction roll 84 and an allocated hood 86.

In this layout the fibrous web 32 is carried over the suction roll 84 together with the permeable structured fabric 38, whereby the fibrous web 32 is located between the permeable structured fabric 38 and the suction roll 84.

The permeable structured fabric 38 and the fibrous web 32 can be pressed by a permeable press belt 88 against the suction roll 84. A specific pressing pressure generated by the permeable press belt 88 of ≦1.5 bar and especially ≦1 bar is preferred.

In addition, a dewatering fabric 90 which is located between the suction roll 84 and the permeable structured fabric 38 can be routed around the suction roll 84.

In this arrangement therefore, hot air may especially flow successively from the hood 86 through the permeable press belt 88, the permeable structured fabric 38, the fibrous web 32 and the dewatering fabric 90 into the suction zone 92 of the suction roll 84. For this purpose the hood 86 is located, at least substantially in the area of the suction zone 92 of the suction roll 84.

Following the drying device 82 the fibrous web 32 is run through a press nip 98 which is formed between a dryer cylinder 94, especially a Yankee-cylinder and a press element 96. As illustrated, the press element 96 can be in the embodiment, for example, of a press roll.

In the current design example at least one suction equipped embossing unit 62 each is provided between the forming roll 36 and the drying device 82, as well as between the drying device 82 and the press nip 98.

It is also especially advantageous if a cleaning device 102 is allocated to at least one guide roll 100, including the press roll 96 which are located inside the loop of the structured fabric 38. Such a cleaning device 102 could for example include a doctor blade 104, a catch pan 106 and/or a similar device.

The structured fabric 38 can especially be in the embodiment of a woven wire.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Component Identification List

10 Outfeed nip
12 Forming roll
14 Permeable structured fabric
16 Dewatering fabric
18 Spray water
20 Stock infeed nip
22 Headbox
24 Fibrous web
26 Catch pan
28 Guide roll
30 Device
32 Fibrous web
34 Headbox
36 Forming element, forming roll
38 Structured fabric
40 Dewatering fabric
42 Stock infeed nip
44 Outfeed nip
46 Catch pan
48 Outlet
50 Wall section
52 Discharge pipe
54 Base section
56 Side
58 Orifice
60 Vacuum chamber
62 Embossing unit
64 Base section
66 Side
68 Edge
70 Suction channel
72 Orifice
74 Vacuum chamber
76 Inside
78 Outside

80 Fibers, Fines
82 Drying device
84 Suction roll
86 Hood
88 Permeable press belt
90 Dewatering fabric
92 Suction zone
94 Dryer cylinder, Yankee-cylinder
96 Press element
98 Press nip
100 Guide roll
102 Cleaning device
104 Doctor blade
106 Catch pan
L Direction of web travel
M Arrows

What is claimed is:

1. An apparatus to produce a web of fibrous material having a three dimensional surface structure, said apparatus comprising:

a headbox;

a forming element;

a structured fabric, said forming element and said structured fabric coming off of said forming element forming an outfeed nip therebetween;

a dewatering fabric, said structured fabric and said dewatering fabric running together and forming a stock infeed nip and being carried over said forming element such that said structured fabric is an inside fabric and said dewatering fabric is an outside fabric, said headbox feeding a fibrous suspension into said stock infeed nip; and at least one catch pan in an area of the apparatus associated with said outfeed nip for at least one of water, a plurality of fibers, and a plurality of fines occurring in said area of the apparatus associated with said outfeed nip, said catch pan includes at least one suction equipped orifice and a base section with one side which faces said structured fabric, said at least one suction equipped orifice being on said side of said base section facing said structured fabric.

2. The apparatus according to claim 1, wherein said forming element is a forming roll.

3. The apparatus according to claim 1, wherein said catch pan includes an outlet and a wall section in order to collect said water accumulating in said area of the apparatus associated with said outfeed nip and to direct said water to said outlet.

4. The apparatus according to claim 3, further including a vacuum source, said outlet being connected to said vacuum source.

5. The apparatus according to claim 1, wherein said catch pan includes a plurality of said suction equipped orifices on said side of said base section facing said structured fabric.

6. The apparatus according to claim 1, wherein said base section includes a vacuum chamber located therein, said at least one orifice being connected with said vacuum chamber located in said base section.

7. The apparatus according to claim 6, further including a vacuum source, said vacuum chamber being connected to said vacuum source.

8. The apparatus according to claim 1, wherein said at least one orifice is formed as one of a bore and a slot.

9. The apparatus according to claim 1, wherein said structured fabric has a progression having a horizontal component in an area of the apparatus adjacent to said forming element.

10. The apparatus according to claim 1, wherein said structured fabric is one of an open and a permeable fabric.

11. The apparatus according to claim 10, wherein said structured fabric has a permeability of >200 cubic feet per minute.

12. The apparatus according to claim 10, wherein said structured fabric has a permeability of >400 cubic feet per minute.

13. The apparatus according to claim 10, wherein said structured fabric has a permeability of >600 cubic feet per minute.

14. The apparatus according to claim 1, further including at least one suction-equipped embossing unit provided after said forming element relative to a direction of travel of the web, said structured fabric being permeable, said at least one suction-equipped embossing unit being located on a side of said structured fabric which faces away from the web and being configured for sucking the web into a structure of said structured fabric.

15. The apparatus according to claim 1, further including at least one guide roll and a cleaning device, said at least one guide roll being located inside a loop of said structured fabric, said cleaning device being allocated to said at least one guide roll.

16. The apparatus according to claim 15, wherein said cleaning device includes at least one of a doctor blade and a catch pan.

17. The apparatus according to claim 1, wherein the apparatus has a machine operating speed which is >900 m/min.

18. The apparatus according to claim 1, wherein the apparatus has a machine operating speed which is >1200 m/min.

19. The apparatus according to claim 1, wherein said structured fabric is a woven wire.

20. The apparatus according to claim 1, wherein the web has a basis weight which is <40 g/m$^2$.

21. The apparatus according to claim 1, wherein the web has a basis weight which is <25 g/m$^2$.

22. An apparatus to produce a web of fibrous material having a three dimensional surface structure, said apparatus comprising:

a headbox;

a forming element;

a structured fabric, said forming element and said structured fabric coming off of said forming element forming an outfeed nip therebetween;

a dewatering fabric, said structured fabric and said dewatering fabric running together and forming a stock infeed nip and being carried over said forming element such that said structured fabric is an inside fabric and said dewatering fabric is an outside fabric, said headbox feeding a fibrous suspension into said stock infeed nip;

at least one catch pan in an area of the apparatus associated with said outfeed nip for at least one of water, a plurality of fibers, and a plurality of fines occurring in said area of the apparatus associated with said outfeed nip; and at least one suction-equipped embossing unit provided after said forming element relative to a direction of travel of the web, said structured fabric being permeable, said at least one suction-equipped embossing unit being located on a side of said structured fabric which faces away from the web and being configured for sucking the web into a structure of said structured fabric, said suction-equipped embossing unit includes a base section with one side facing said structured fabric and with a front edge, relative to said direction of travel of the web, on said side of said structured fabric which faces away from the web, said suction-equipped embossing unit being equipped with at least one suction channel located in an area of said base section associated with said front edge in order to suck off at least one of a plurality of contaminants, a plurality of water drops, a plurality of fines, and a plurality of fibers which are carried along by said structured fabric.

23. The apparatus according to claim 22, wherein said base section includes at least one suction-equipped orifice on said side of said base section of said suction-equipped embossing unit facing said structured fabric.

24. The apparatus according to claim 23, wherein said base section includes a vacuum chamber located therein, said at least one suction-equipped orifice being connected with said vacuum chamber.

25. The apparatus according to claim 24, further including a vacuum source, said vacuum chamber of said embossing unit being connected with said vacuum source.

26. The apparatus according to claim 24, wherein said suction channel and said at least one suction-equipped orifice are connected with said vacuum chamber of said embossing unit.

27. The apparatus according to claim 22, wherein said at least one suction-equipped embossing unit is located in an area of the apparatus where a dry content of the web is <35%.

28. The apparatus according to claim 22, further including a drying unit including a suction roll and a hood associated therewith.

29. The apparatus according to claim 28, wherein the web is carried over said suction roll together with said structured fabric and is located between said structured fabric and said suction roll.

30. The apparatus according to claim 29, further including a permeable press belt, said structured fabric and the web being pressed by said permeable press belt against said suction roll.

31. The apparatus according to claim 30, wherein said permeable press belt generates a specific pressing pressure which is ≦1.5 bar.

32. The apparatus according to claim 30, wherein said permeable press belt generates a specific pressing pressure which is ≦1 bar.

33. The apparatus according to claim 30, further including a dewatering fabric which is located between said suction roll and said structured fabric and which is routed around said suction roll.

34. The apparatus according to claim 28, further including a drying cylinder and a press element forming a press nip therebetween, wherein, following said drying unit, the web is run through said press nip formed between said drying cylinder and said press element.

35. The apparatus according to claim 34, wherein said drying cylinder is a Yankee cylinder.

36. The apparatus according to claim 34, wherein said at least one suction-equipped embossing unit is located between said forming element and said drying unit.

37. The apparatus according to claim 34, wherein said at least one suction-equipped embossing device is located between said drying unit and said press nip formed between said drying cylinder said press element.

38. The apparatus according to claim 34, wherein the apparatus includes at least two said suction-equipped embossing devices, one of said suction-equipped embossing devices being located between said forming element and said drying unit, and said other of said suction-equipped embossing devices being located between said drying unit and said press nip formed between said drying cylinder said press element.

* * * * *